US010316584B1

(12) United States Patent
Cooper

(10) Patent No.: US 10,316,584 B1
(45) Date of Patent: Jun. 11, 2019

(54) BATHROOM VANITY WITH RETRACTABLE STEP

(71) Applicant: Sunjoy Industries Group Ltd., Steubenville, OH (US)

(72) Inventor: John David Cooper, Lawrenceville, GA (US)

(73) Assignee: Sunjoy Industries Group Ltd., Steubenville, OH (US)

( * ) Notice: Subject to any disclaimer, the term of this patent is extended or adjusted under 35 U.S.C. 154(b) by 0 days.

(21) Appl. No.: 15/909,861

(22) Filed: Mar. 1, 2018

(51) Int. Cl.

| | |
|---|---|
| ***E06C 1/00*** | (2006.01) |
| ***A47B 46/00*** | (2006.01) |
| ***E03C 1/04*** | (2006.01) |
| ***A47K 1/12*** | (2006.01) |
| *A47C 12/00* | (2006.01) |

(52) U.S. Cl.
CPC ..... *E06C 1/005* (2013.01); *A47B 46/00* (2013.01); *A47K 1/12* (2013.01); *E03C 1/04* (2013.01); *A47B 2200/12* (2013.01); *A47B 2220/03* (2013.01); *A47B 2220/05* (2013.01); *A47C 12/00* (2013.01)

(58) Field of Classification Search
CPC ..... B60R 7/08; B60R 7/02; B60R 2011/0042; B60R 2011/0084; A47B 2210/16; A47B 2220/06
USPC ..... 312/330.1, 291, 137, 404, 270.1, 270.3, 312/301, 235.1, 235.2
See application file for complete search history.

(56) References Cited

U.S. PATENT DOCUMENTS

| | | | | |
|---|---|---|---|---|
| 470,378 | A * | 3/1892 | Hamblin | |
| 1,973,628 | A | 9/1934 | Hindle | |
| 2,628,879 | A * | 2/1953 | Schultz | A47B 79/00 297/423.21 |
| 2,731,318 | A * | 1/1956 | Hoff | A47B 67/005 312/210 |
| 2,947,589 | A * | 8/1960 | Darbo | A47B 77/10 108/93 |
| 3,311,190 | A | 3/1967 | Naumann | |
| 3,481,429 | A | 12/1969 | Gaede | |
| 4,545,628 | A | 10/1985 | Richey | |

(Continued)

FOREIGN PATENT DOCUMENTS

| | | | |
|---|---|---|---|
| AT | 517900 | * | 5/2017 |
| CA | 2326461 | * | 5/2002 |

(Continued)

*Primary Examiner* — Janet M Wilkens
(74) *Attorney, Agent, or Firm* — The Law Office of Patrick F. O'Reilly III, LLC

(57) ABSTRACT

A bathroom vanity with a retractable step is disclosed herein. The bathroom vanity includes a cabinet body portion including a top wall and a plurality of sidewalls, and defining a bottom recess with an open bottom; and a retractable step slidingly coupled to the cabinet body portion and being displaceable between a stowed position where the retractable step is disposed within the bottom recess of the cabinet body portion and an extended position where the retractable step extends outwardly from a front of the cabinet body portion so as to provide a step for a user of the bathroom vanity, the retractable step being configured to slide along a floor on which the bathroom vanity is disposed when the retractable step is displaced, and at least a portion of the retractable step being configured to contact the floor when the retractable step is displaced.

20 Claims, 10 Drawing Sheets

(56) References Cited

U.S. PATENT DOCUMENTS

| | | | | |
|---|---|---|---|---|
| 4,597,122 | A * | 7/1986 | Handler | A47C 17/86 217/62 |
| 4,874,209 | A * | 10/1989 | Spitzer | A47B 88/70 312/249.9 |
| 4,924,970 | A | 5/1990 | Seals et al. | |
| 5,005,667 | A | 4/1991 | Anderson | |
| 5,009,282 | A | 4/1991 | Willsher | |
| 5,277,487 | A | 1/1994 | Simon | |
| 5,341,897 | A | 8/1994 | Gross | |
| 5,735,586 | A | 4/1998 | Cheng | |
| 5,755,498 | A * | 5/1998 | Cutler | A47B 46/00 312/235.1 |
| 6,364,441 | B1 | 4/2002 | Arnold | |
| 6,371,584 | B1 | 4/2002 | Alreck | |
| 6,425,457 | B1 | 7/2002 | Lundry | |
| D490,629 | S | 6/2004 | Holley | |
| 6,802,578 | B1 | 10/2004 | Lang et al. | |
| D535,368 | S | 1/2007 | Nelson | |
| 7,386,899 | B2 | 6/2008 | Smith | |
| D594,258 | S | 6/2009 | Zuniga et al. | |
| D731,037 | S | 6/2015 | Ouyang | |
| 9,856,654 | B1 * | 1/2018 | Tagart | E04F 11/062 |
| 2005/0082954 | A1 | 4/2005 | Dunbar et al. | |
| 2005/0099101 | A1 * | 5/2005 | Lowe | A47B 67/04 312/228 |
| 2005/0164855 | A1 * | 7/2005 | Li | A63B 23/0458 482/142 |
| 2006/0284526 | A1 * | 12/2006 | Pathmanathan | A47B 46/00 312/228.1 |
| 2008/0264723 | A1 * | 10/2008 | Tatum | A47C 12/00 182/35 |
| 2011/0214942 | A1 | 9/2011 | Niemiec | |
| 2012/0060334 | A1 * | 3/2012 | Gesell | A61G 17/00 27/1 |
| 2012/0298450 | A1 | 11/2012 | Sanz | |
| 2015/0238007 | A1 * | 8/2015 | Faller | A47B 3/0912 108/14 |
| 2018/0070722 | A1 * | 3/2018 | Yang | A47B 83/00 |

FOREIGN PATENT DOCUMENTS

| | | | |
|---|---|---|---|
| DE | 202013008496 | * | 11/2013 |
| DE | 202014002438 | * | 4/2014 |
| EP | 709049 | * | 5/1996 |
| GB | 1169686 | * | 11/1969 |
| GB | 1227808 A | | 4/1971 |
| JP | 2006055543 A | | 3/2006 |
| JP | 2012242078 | * | 12/2012 |
| WO | 2010121622 A1 | | 10/2010 |

* cited by examiner

Section A-A

BATHROOM VANITY WITH RETRACTABLE STEP

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a bathroom vanity with a retractable step. More particularly, the invention relates to a bathroom vanity with a retractable step for enabling easier access to the top of the bathroom vanity for individuals having a small stature (e.g., children).

2. Background

A typical bathroom vanity has a countertop height in the range between 30 inches and 36 inches (e.g., 32 inches). For individuals having a small stature, such as children, this countertop height makes reaching items on the top of the countertop difficult, such as the sink faucet, etc. In order to reach the top of the countertop, it is possible for these individuals to utilize a conventional step stool. However, a conventional step stool tends to obstruct access to the vanity for those individuals who do need the step stool, unless the step stool is stowed each time it is used. And, stowing the step stool after each use is inconvenient and cumbersome, thus interfering with the enjoyable use of the vanity.

Therefore, what is needed is a bathroom vanity with a built-in retractable step that enables individuals with a small stature, such as children, to reach items on the top of the bathroom vanity (e.g., the sink faucet) without requiring a separate step stool, and without requiring help from someone else (e.g., a parent or older brother or sister). Moreover, a bathroom vanity is needed that has a built-in retractable step that is easily pulled out from the vanity when needed, and then easily retracted back into vanity when it is not needed. Furthermore, a bathroom vanity is needed that has a retractable step with a built-in storage compartment so that the step may also be used as a drawer to store various items (e.g., towels or toiletries).

BRIEF SUMMARY OF EMBODIMENTS OF THE INVENTION

Accordingly, the present invention is directed to a bathroom vanity with a retractable step that substantially obviates one or more problems resulting from the limitations and deficiencies of the related art.

In accordance with one or more embodiments of the present invention, there is provided a bathroom vanity that includes a cabinet body portion including a top wall and a plurality of sidewalls, the cabinet body portion defining a bottom recess with an open bottom; and a retractable step slidingly coupled to the cabinet body portion, the retractable step being displaceable between a stowed position where the retractable step is disposed within the bottom recess of the cabinet body portion and an extended position where the retractable step extends outwardly from a front of the cabinet body portion so as to provide a step for a user of the bathroom vanity, the retractable step being configured to slide along a floor on which the bathroom vanity is disposed when the retractable step is displaced between the stowed position and the extended position, and at least a portion of the retractable step being configured to contact the floor when the retractable step is displaced between the stowed position and the extended position.

In a further embodiment of the present invention, the top wall of the cabinet body portion is in the form of a countertop with an aperture for accommodating a sink bowl.

In yet a further embodiment, the cabinet body portion further comprises a main cabinet compartment with at least one door pivotably mounted to the cabinet body portion, the at least one door pivotal between a closed position where the main cabinet compartment is generally enclosed and an open position where a user is able to gain access to an interior of the main cabinet compartment.

In still a further embodiment, the plurality of sidewalls of the cabinet body portion comprise a first sidewall, a second sidewall oppositely disposed relative to the first sidewall, and one or more rear walls partially enclosing a backside of the cabinet body portion.

In yet a further embodiment, the retractable step further defines a storage compartment for receiving one or more items configured to be stored within the bathroom vanity.

In still a further embodiment, the retractable step further comprises a removable lid for gaining access to the storage compartment, the removable lid configured to form a top stepping surface of the retractable step when the removable lid is covering the storage compartment.

In yet a further embodiment, the removable lid of the retractable step further comprises one or more protruding members extending from a bottom surface of the removable lid, the one or more protruding members configured to engage with a frame portion of the retractable step so as to retain the removable lid in place.

In still a further embodiment, the one or more protruding members of the removable lid of the retractable step are in the form of one or more block members, the one or more block members of the removable lid configured to be received between one or more pairs of frame members of the frame portion of the retractable step.

In yet a further embodiment, the removable lid of the retractable step is not pivotally attached to the frame portion of the retractable step by a hinge.

In still a further embodiment, the retractable step further comprises a plurality of walls bounding the storage compartment, the plurality of walls including peripheral sidewalls and a bottom wall, the peripheral sidewalls forming at least a part of the frame portion of the retractable step.

In yet a further embodiment, the retractable step further comprises a pair of spaced-apart interior walls, the removable lid of the storage compartment configured to engage with one or more of the peripheral sidewalls and/or one or more of the spaced-apart interior walls.

In still a further embodiment, the retractable step further comprises a plurality of casters, the plurality of casters configured to slide along the floor as the retractable step is displaced between the stowed position and the extended position.

In yet a further embodiment, the bottom recess of the cabinet body portion is bounded by an interior top partition wall and at least two of the plurality of sidewalls of the cabinet body portion, the open bottom of the bottom recess configured to be bounded by the floor on which the bathroom vanity is disposed.

In still a further embodiment, the retractable step is connected to the cabinet body portion by one or more slidable tracks.

In yet a further embodiment, the retractable step further comprises one or more handles disposed on a front wall of the retractable step for facilitating the grasping and pulling of the retractable step from the stowed position to the extended position by a user.

In accordance with one or more other embodiments of the present invention, there is provided a bathroom vanity that includes a cabinet body portion including a top wall and a plurality of sidewalls, the cabinet body portion defining a bottom recess with an open bottom; and a retractable step slidingly coupled to the cabinet body portion, the retractable step being displaceable between a stowed position where the retractable step is disposed within the bottom recess of the cabinet body portion and an extended position where the retractable step extends outwardly from a front of the cabinet body portion so as to provide a step for a user of the bathroom vanity, the retractable step defining a storage compartment for receiving one or more items configured to be stored within the bathroom vanity, the retractable step being configured to slide along a floor on which the bathroom vanity is disposed when the retractable step is displaced between the stowed position and the extended position, and at least a portion of the retractable step being configured to contact the floor when the retractable step is displaced between the stowed position and the extended position.

In a further embodiment of the present invention, the retractable step further comprises a removable lid for gaining access to the storage compartment, the removable lid configured to form a top stepping surface of the retractable step when the removable lid is covering the storage compartment.

In yet a further embodiment, the retractable step further comprises a plurality of walls bounding the storage compartment, the plurality of walls including peripheral sidewalls and a bottom wall.

In still a further embodiment, the retractable step further comprises a pair of spaced-apart interior walls, the removable lid of the storage compartment configured to engage with one or more of the peripheral sidewalls and/or one or more of the spaced-apart interior walls.

In yet a further embodiment, the removable lid of the retractable step further comprises one or more protruding members extending from a bottom surface of the removable lid, the one or more protruding members configured to engage with the one or more of the peripheral sidewalls and/or the one or more of the spaced-apart interior walls.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
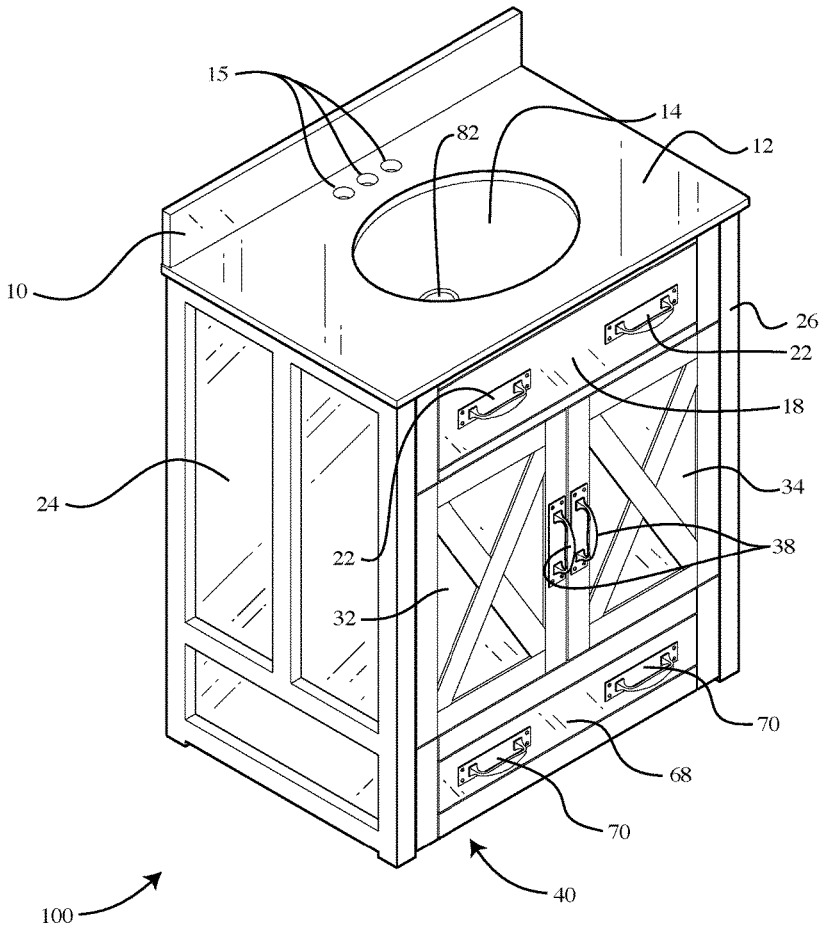
FIG. 1 is a perspective view of a bathroom vanity with a retractable step, according to an embodiment of the invention, wherein the retractable step of the bathroom vanity is disposed in its stowed position.

An illustrative embodiment of a bathroom vanity 100 with a retractable step 40 is shown in FIGS. 1-6 and 8-10. Initially, referring to FIGS. 1-5, it can be seen that the bathroom vanity 100 generally comprises a cabinet body portion and retractable step. The cabinet body portion includes a top wall 12 and a plurality of sidewalls 16, 24, 26, 30, and the cabinet body portion defines a bottom recess (i.e., bounded by panels 24, 26, 30) with an open bottom. The retractable step 40 is slidingly coupled to the cabinet body portion (e.g., by sliding track subassemblies 48, 50). The retractable step 40 is displaceable between a stowed position where the retractable step is disposed within the bottom recess of the cabinet body portion (i.e., the FIG. 1 position) and an extended position where the retractable step extends outwardly from a front of the cabinet body portion so as to provide a step for a user (e.g., child 74) of the bathroom vanity (i.e., the FIG. 5 position). The retractable step 40 is configured to slide along a floor on which the bathroom vanity 100 is disposed when the retractable step is displaced between the stowed position and the extended position (i.e., displaced between the FIG. 1 position and the FIG. 5 position). In the illustrative embodiment, when the retractable step is displaced between the stowed position (FIG. 1) and the extended position (FIG. 5), and at least a portion of the retractable step 40 is configured to contact the floor (i.e., the bottom surfaces of the casters 72 contact the floor).

Figure 4:
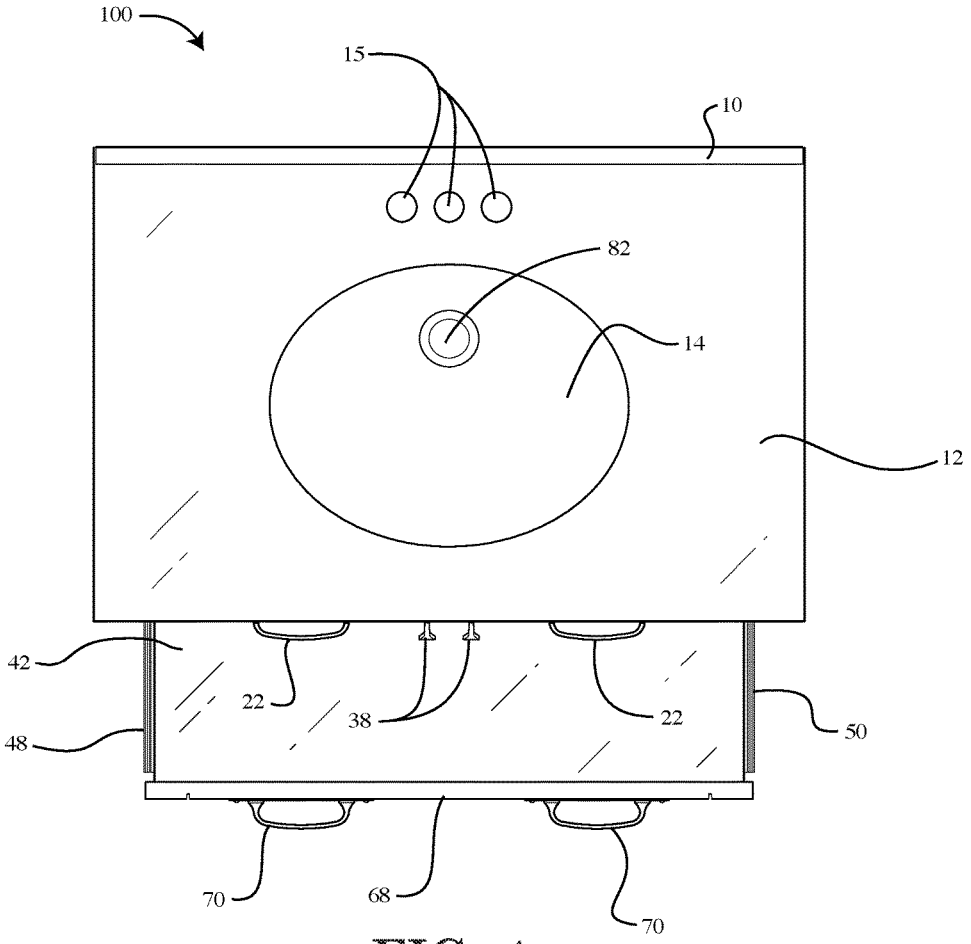
FIG. 4 is a top plan view of the bathroom vanity of FIG. 1, wherein the retractable step of the bathroom vanity is disposed in its extended position.
Figure 9:
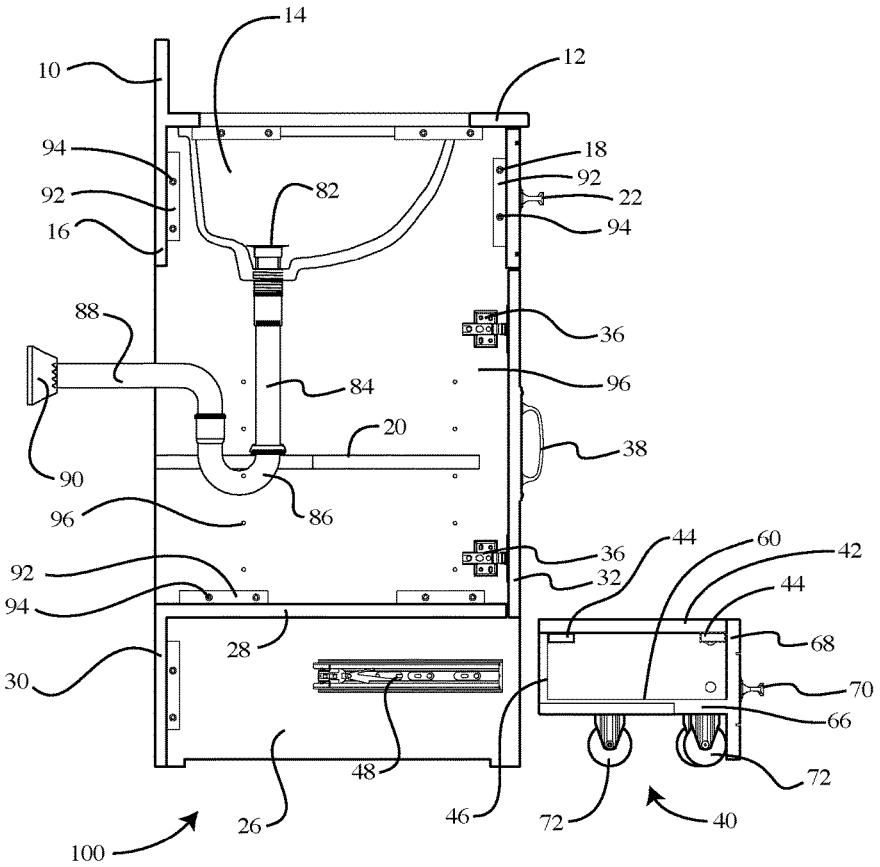
FIG. 9 is a first longitudinal sectional view of the bathroom vanity of FIG. 1, wherein the section is generally cut along the cutting-plane line A-A in FIG. 2.
Figure 10:
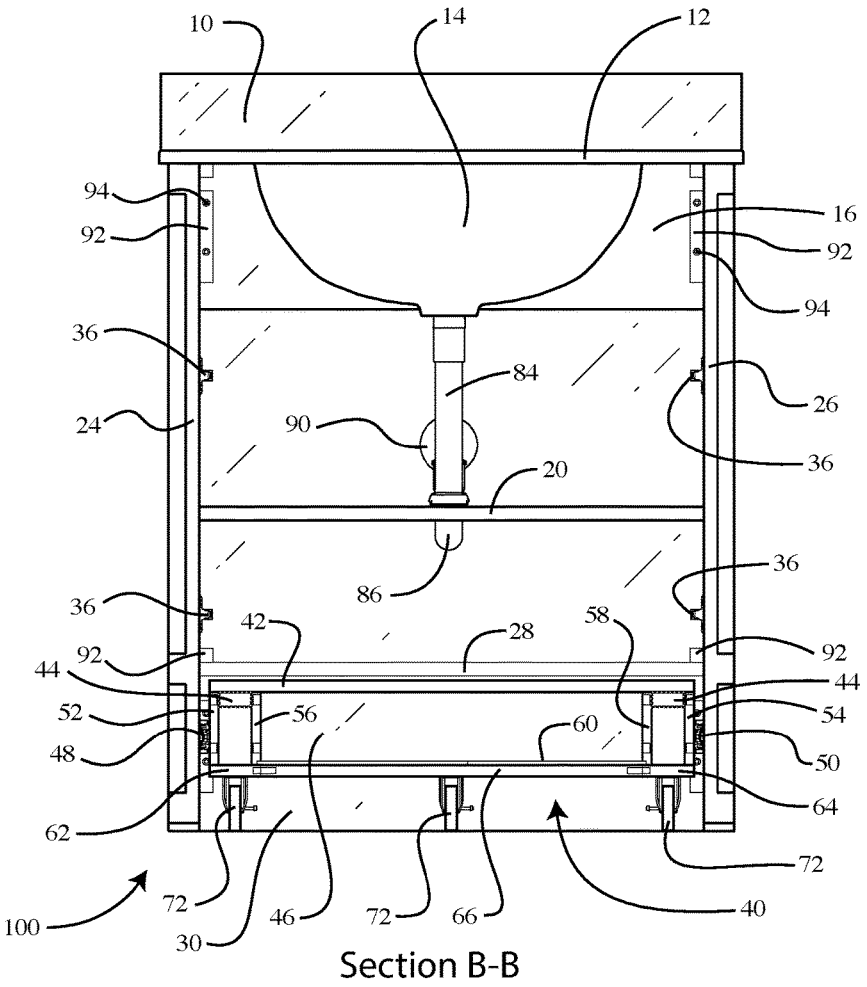
FIG. 10 is a second longitudinal sectional view of the bathroom vanity of FIG. 1, wherein the section is generally cut along the cutting-plane line B-B in FIG. 3.

Referring particularly to FIGS. 1-5, the features of the illustrative cabinet body portion of the bathroom vanity 100 will be described in detail. As most clearly shown in FIGS. 1 and 4, in the illustrative embodiment, the top wall of the cabinet body portion of the bathroom vanity 100 is in the form of a countertop 12 with an aperture for accommodating a sink bowl 14. Also, as illustrated in FIGS. 1 and 4, the countertop 12 of the bathroom vanity 100 may further comprise a countertop backsplash 10 and a plurality of faucet apertures 15 disposed therethrough for accommodating the water supply piping of the sink faucet. Turning to the sectional views of FIGS. 9 and 10, in the illustrative embodiment, the sink bowl 14 may include a sink drain 82 disposed at the bottom of the sink bowl 14, which includes a sink drain tailpiece 84 that is connected to a P-trap 86. As shown in FIG. 9, in the illustrative embodiment, the P-trap 86 is connected to a waste line 88 that extends through the wall behind the bathroom vanity 100. The waste line 88 carries the waste water from the sink 14 to the sanitary system of the building structure (e.g., home) in which the bathroom vanity 100 is disposed. As illustrated in FIGS. 9 and 10, the waste line 88 may be provided with an escutcheon plate 90 disposed therearound at the point where the waste line 88 enters into the wall to improve the aesthetics of the installation.

In the illustrative embodiment, the sink bowl 14 and the associated drain components 82, 84, 86, 88, 90 are merely shown in FIGS. 1, 4, 5, and 8-10 in order to better illustrate the environment in which the bathroom vanity 100 is used. It is to be understood that the bathroom vanity 100 is typically provided without the sink bowl 14, and is almost always provided without the associated drain components 82, 84, 86, 88, 90. As such, in these embodiments, the countertop 12 of the bathroom vanity 100 simply includes a sink aperture and the faucet apertures 15 so that the user can install the sink and faucet of his or her choice within the bathroom vanity 100.

Turning again to FIGS. 1-5, 9, and 10, additional features of the illustrative cabinet body portion of the bathroom vanity 100 will be explained. In the illustrative embodiment, the cabinet body portion further comprises a main cabinet compartment with a pair of doors 32, 34 pivotably mounted to the cabinet body portion by means of door hinges 36. The cabinet doors 32, 34 of the illustrative bathroom vanity 100 are pivotal between a closed position where the main cabinet compartment is generally enclosed and an open position where a user is able to gain access to an interior of the main cabinet compartment. Each of the cabinet doors 32, 34 may be provided with a door handle 38 disposed on the front thereof for facilitating the grasping and opening of the cabinet doors 32, 34 by a user.

Also, as best shown in FIGS. 1, 2, 9, and 10, in the illustrative embodiment, the plurality of sidewalls of the cabinet body portion comprise a first sidewall 24, a second sidewall 26 oppositely disposed relative to the first sidewall 24, and rear walls 16, 30 partially enclosing a backside of the cabinet body portion. The first and second sidewalls 24, 26 form the bounding sidewalls of the main cabinet compartment. As shown in the sectional view of FIG. 9, the upper rear wall 16 is disposed behind the sink 14, and has a bottom edge at approximately the base of the sink 14. The upper rear wall 16 forms a partial back wall of the main cabinet compartment. In the illustrative embodiment, the remainder of the back of the main cabinet compartment is open to the wall on which the bathroom vanity 100 is disposed (i.e., the bathroom wall of the building forms the remainder of the back wall of the main cabinet compartment so as to enclose the main cabinet compartment). Also, as shown in FIG. 9, the lower rear wall 30 is disposed below the main cabinet compartment, and forms the back wall adjacent to the bottom recess of the bathroom vanity 100 that receives the retractable step 40 therein. The lower portions of the two sidewalls 24, 26 form the bounding side walls adjacent to the bottom recess of the bathroom vanity 100 (see FIGS. 9 and 10), and the interior partition 28 forms the top wall adjacent to the bottom recess of the bathroom vanity 100. Together, the walls 24, 26, 28, 30 enclose the bottom recess on four (4) sides. The front of the bottom recess of the bathroom vanity 100 is open so as to allow the retractable step 40 to pass therethrough. In the illustrative embodiment, the bottom recess is also open at the bottom thereof, but the bottom of the bottom recess is enclosed by the floor of the room in the installed state of the bathroom vanity 100.

Figure 2:
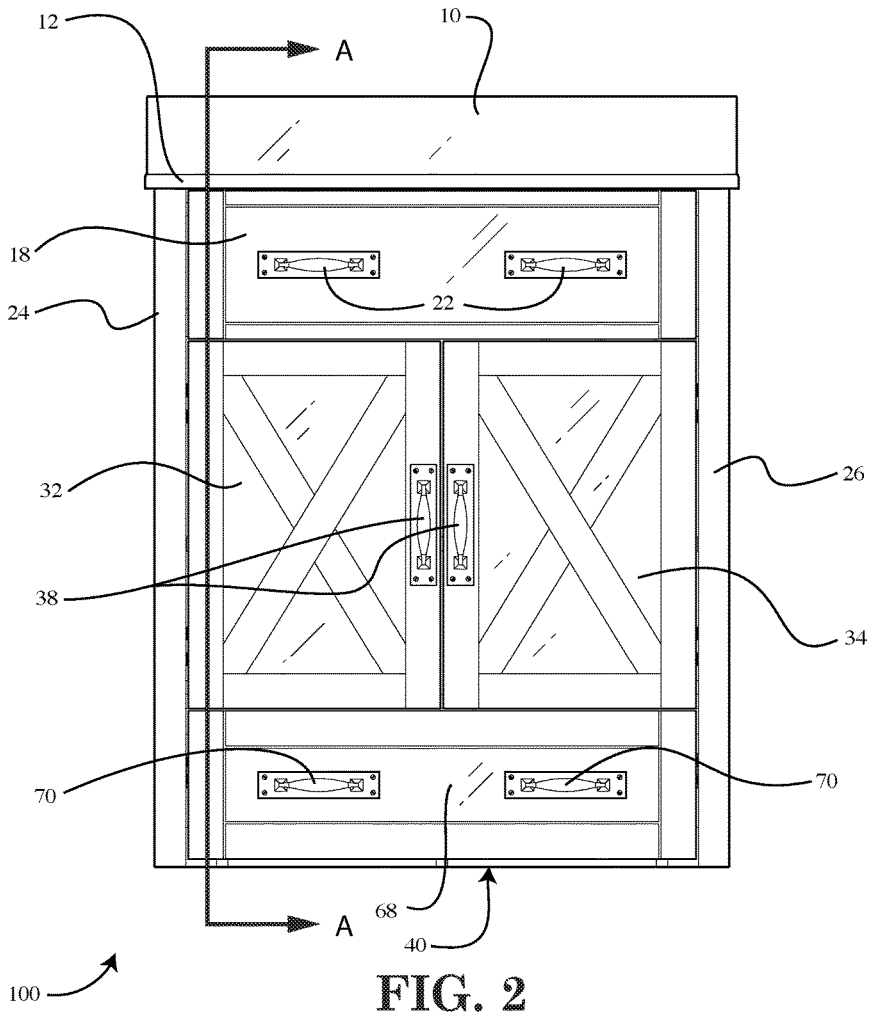
FIG. 2 is a front elevational view of the bathroom vanity of FIG. 1.
Figure 3:
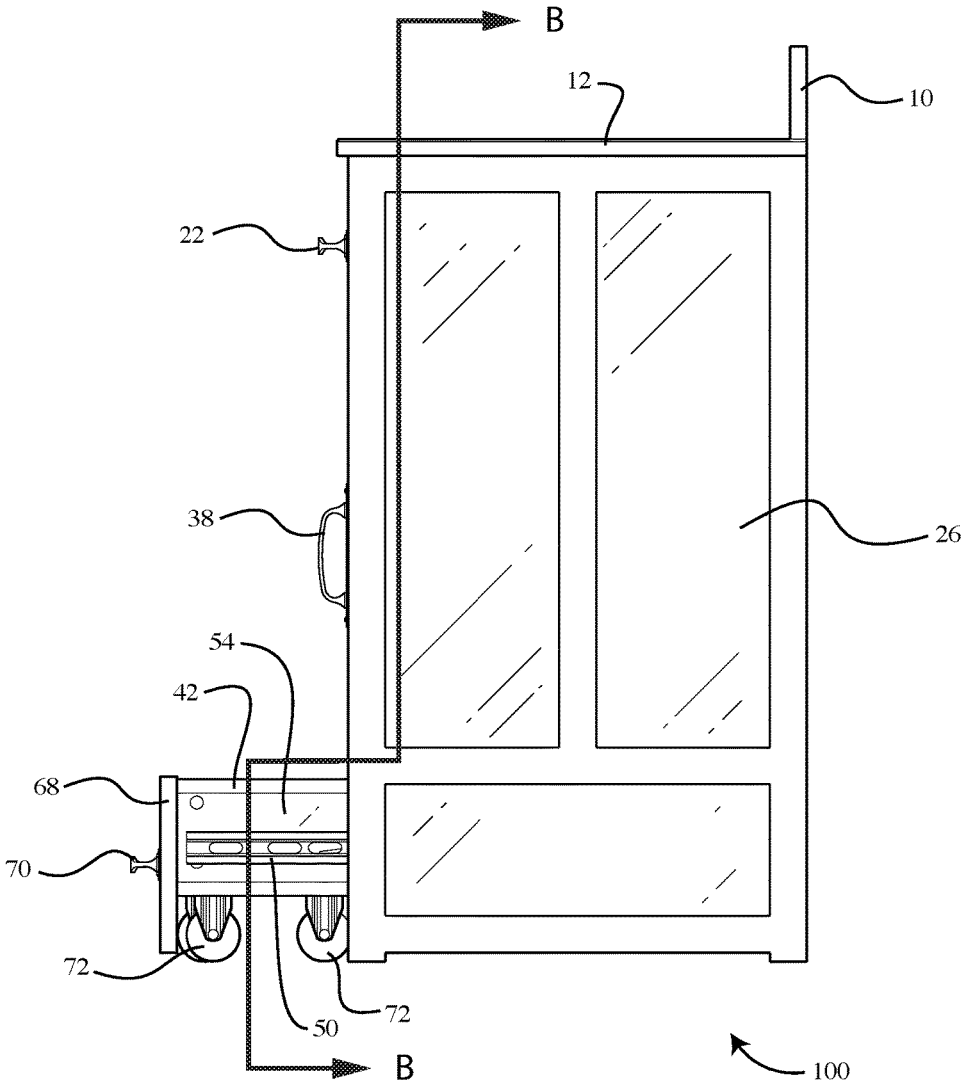
FIG. 3 is a side elevational view of the bathroom vanity of FIG. 1, wherein the retractable step of the bathroom vanity is disposed in its extended position.

As shown in FIGS. 1, 2, 9, and 10, in the illustrative embodiment, the cabinet body portion of the bathroom vanity 100 may further comprise a shelf 20 in the main cabinet compartment for supporting items thereon (e.g., cleaning supplies, toiletries, etc.), which are stored in the main cabinet compartment of the bathroom vanity 100. As shown in FIG. 9, the first and second sidewalls 24, 26 of the bathroom vanity 100 may comprise a plurality of vertically spaced-apart holes or bores 96 formed therein for receiving pegs to support shelf 20 at different mounting heights within the bathroom vanity 100. That is, the spaced-apart holes 96 allow the shelf 20 to be positioned at a selected height by the user to accommodate different items being stored in the main cabinet compartment of the cabinet body portion. Also, as shown in FIGS. 9 and 10, the shelf 20 is vertically spaced apart from the interior partition 28 that forms the top wall of the bottom recess of the bathroom vanity 100, thereby enabling items to be supported on the top of both the shelf 20 and the interior partition 28. As shown in FIGS. 1 and 2, the front of the bathroom vanity 100 may further comprise an upper front panel 18 that simulates the face of a drawer (i.e., the upper front panel 18 is a faux drawer). In the illustrative embodiment, the faux drawer panel 18 may be provided with a pair of drawer handles 22, which match the door handles 38 on the cabinet doors 32, 34.

In the illustrative embodiment, with reference to the sectional views of FIGS. 9 and 10, it can be seen that the wall panels 16, 24, 26, 28, 30 of the cabinet body portion of the bathroom vanity 100 may be connected to one another using a plurality of block members 92 (e.g., wooden blocks) with fastener members 94 (e.g., screws) disposed therethrough. As shown in FIGS. 9 and 10, the block members 92 may be mounted in the corners of the panels 16, 24, 26, 28, 30 so as to connect the panels 16, 24, 26, 28, 30 to one another.

Figure 7:
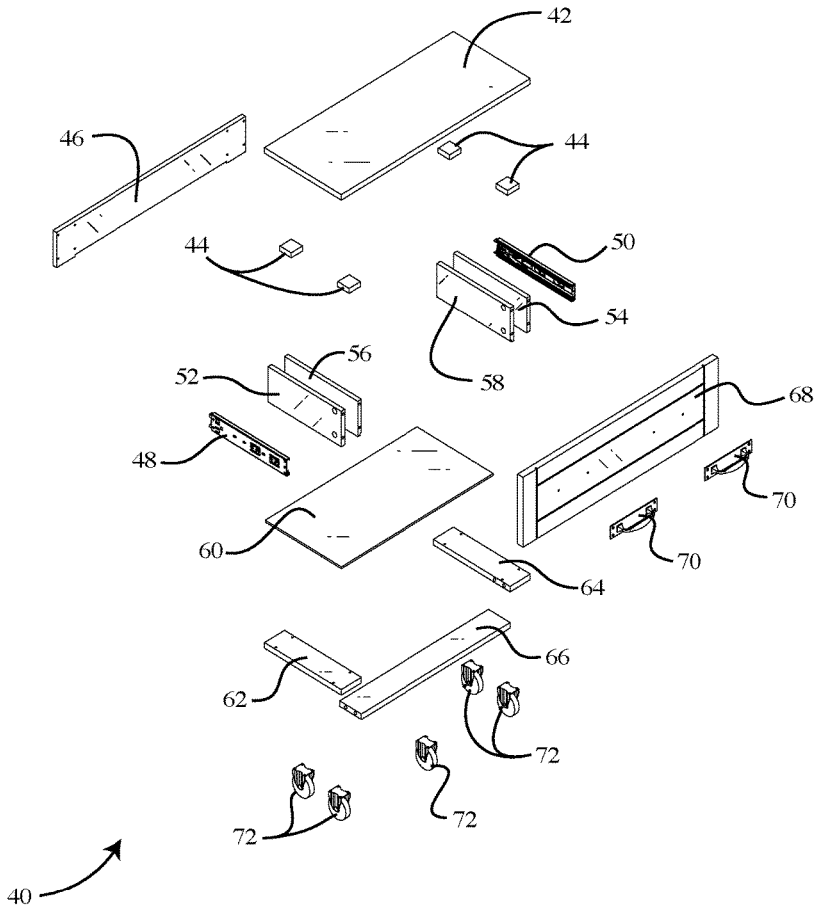
FIG. 7 is an exploded perspective view of the retractable step of the bathroom vanity of FIG. 1.
Figure 8:
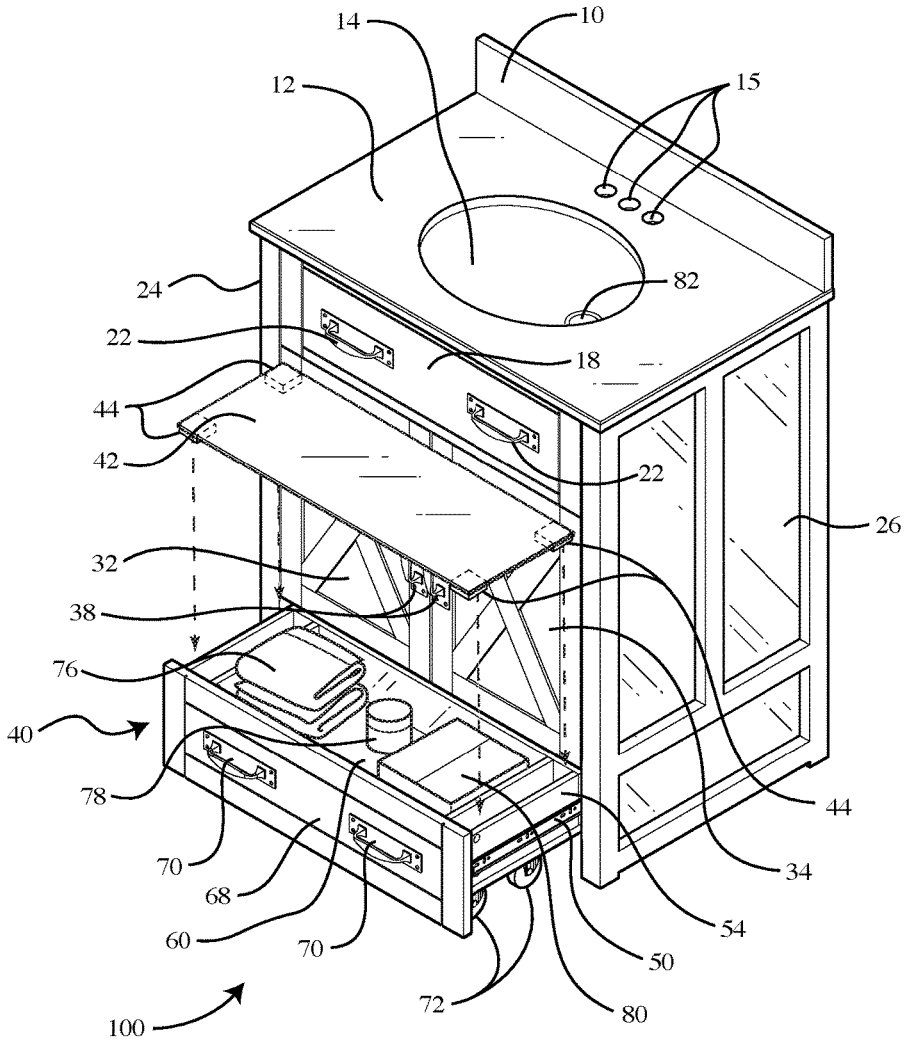
FIG. 8 is yet another perspective view of the bathroom vanity of FIG. 1, wherein the retractable step of the bathroom vanity is disposed in its extended position, and the removable top panel is shown removed from the remainder of the step in order to illustrate the storage compartment inside the step.

Now, with reference primarily to FIGS. 4-8, the retractable step 40 of the illustrative bathroom vanity 100 will be described in detail. As best shown in FIG. 8, in the illustrative embodiment, the retractable step 40 further defines a storage compartment for receiving a plurality of items 76, 78, 80 configured to be stored within the bathroom vanity 100. Advantageously, in the illustrative embodiment, the retractable step 40 is in the form of a combination step/drawer that can be used as both a step and a storage drawer.

Figure 5:
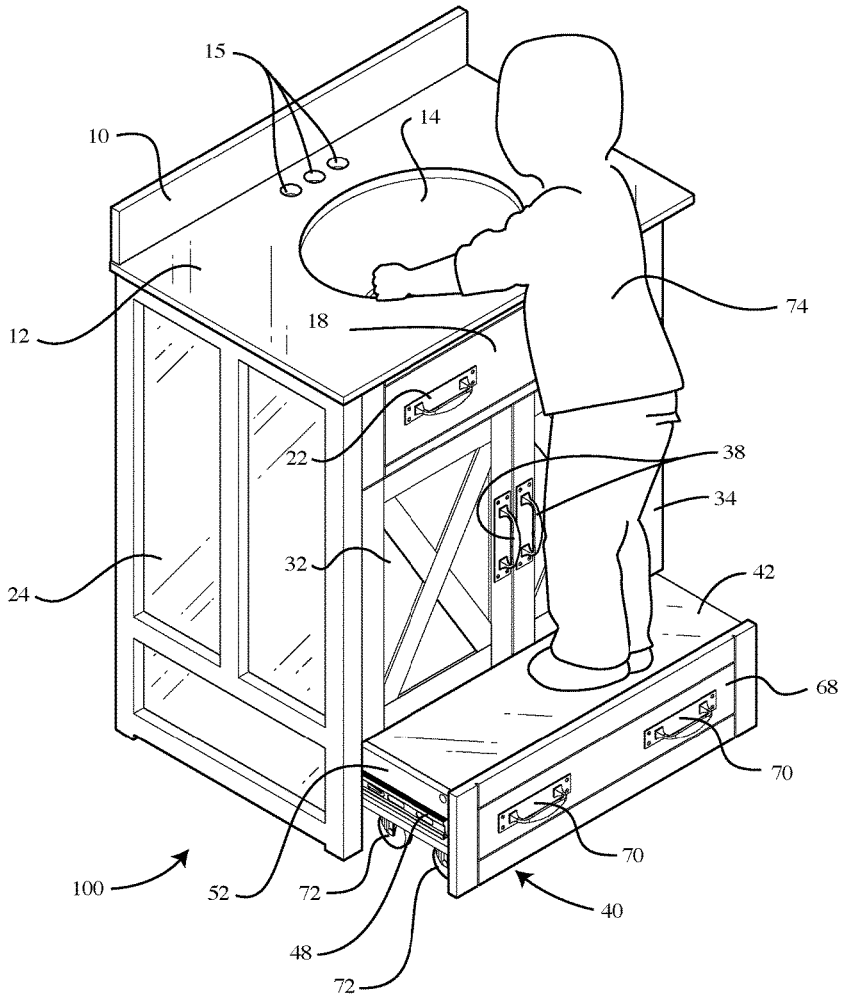
FIG. 5 is another perspective view of the bathroom vanity of FIG. 1, wherein the retractable step of the bathroom vanity is disposed in its extended position, and a user of the bathroom vanity is depicted standing on the step.
Figure 6:
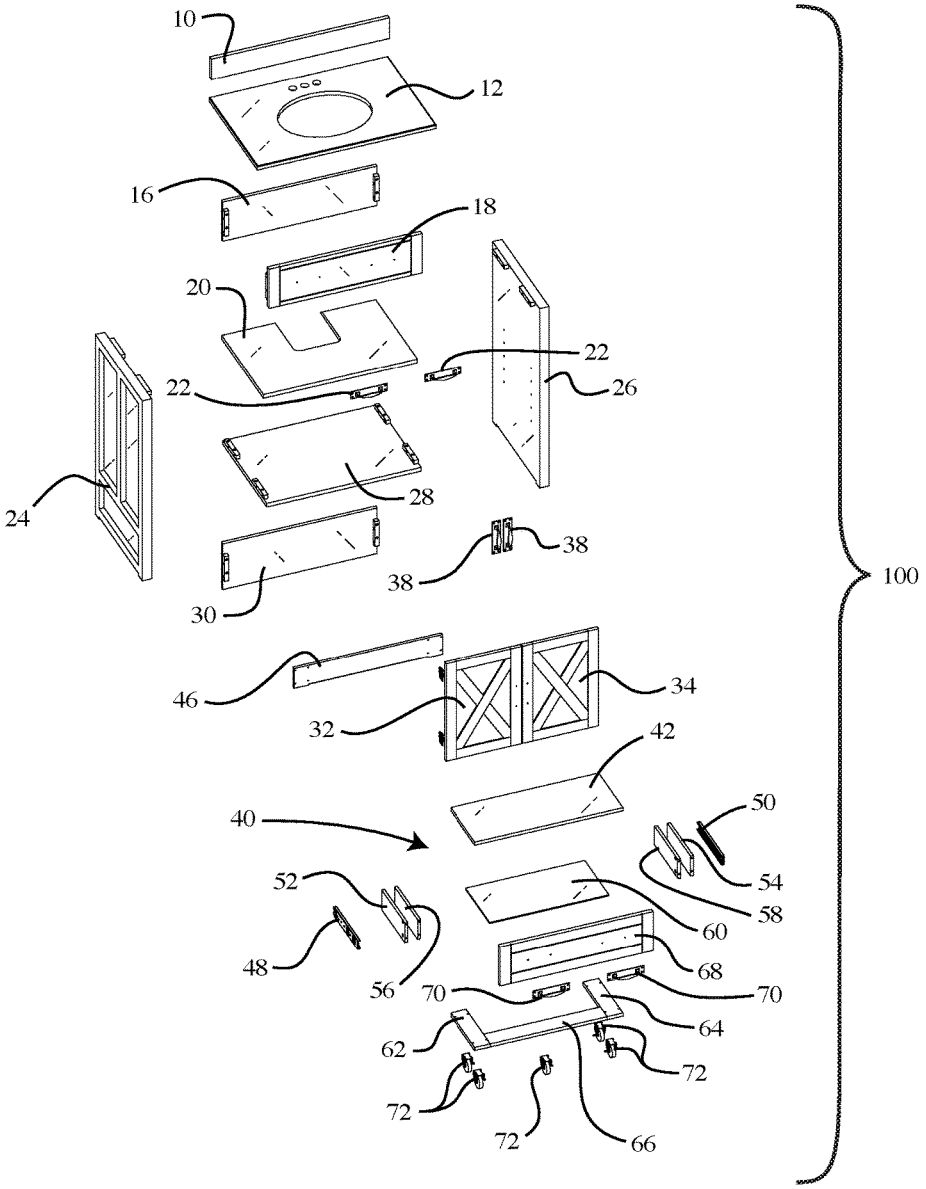
FIG. 6 is an exploded perspective view of the bathroom vanity of FIG. 1.

As such, the overall storage space of the bathroom vanity 100 is not significantly reduced by the inclusion of the retractable step 40. Also, as shown in the illustrative embodiment of FIG. 8, the retractable step 40 further comprises a removable lid 42 (i.e., a removable top panel) for gaining access to the storage compartment. In FIG. 5, it can be seen that the removable lid 42 forms a top stepping surface of the retractable step 40 when the removable lid 42 is covering the storage compartment. Turning to FIGS. 7, 8, and 10, it can be seen that, in the illustrative embodiment, the removable lid 42 of the retractable step 40 further comprises a plurality of protruding members 44 extending from a bottom surface of the removable lid 42. As depicted in the sectional view of FIG. 10, the plurality of protruding members 44 frictionally engage with a frame portion (e.g., peripheral walls 46, 52, 54) of the retractable step 40 so as to retain the removable lid 42 in place. The plurality of protruding members 44 may also frictionally engage with inner partition members 56, 58. Referring again to FIGS. 7 and 8, it can be seen that, in the illustrative embodiment, the plurality of protruding members 44 of the removable lid 42 of the retractable step 40 are in the form of a plurality of block members (e.g., wood block members). As shown in the illustrative embodiment of FIG. 10, the block members 44 of the removable lid 42 are configured to be received between one or more pairs of frame members of the frame portion of the retractable step 42 (e.g., between the peripheral walls 52, 54 and the adjacent inner partitions 56, 58).

In the illustrative embodiment, the removable lid 42 of the retractable step 40 is not pivotally attached to the frame portion (e.g., peripheral walls 46, 52, 54) of the retractable step 40 by a hinge. Rather, as diagrammatically represented in FIG. 8, the removable lid 42 frictionally engages the frame portion of the retractable step 40, and is removable from the remainder of the retractable step 40 by the user applying an upward lifting force on the removable lid 42 to disengage it from the frame portion.

Turning again to FIGS. 7, 8, and 10 of the illustrative embodiment, it can be seen that the retractable step 40 further comprises a plurality of walls 46, 52, 54, 60, 68 bounding the storage compartment. The plurality of walls 46, 52, 54, 60, 68 include a back wall 46, peripheral sidewalls 52, 54, a bottom wall 60, and a front wall 68. In the illustrative embodiment, the peripheral sidewalls 52, 54 form at least a part of the frame portion of the retractable step 40. Also, in the illustrative embodiment, the retractable step 40 further comprises a pair of spaced-apart interior walls 56, 58 that are disposed parallel to, and interiorly from the peripheral sidewalls 52, 54 (see FIGS. 7, 8, and 10). The removable lid 42 of the storage compartment may be configured to engage with the spaced-apart interior walls 56, 58 as well as the peripheral walls 46, 52, 54 (see FIG. 10). Referring to FIGS. 7 and 10, it can be seen that, in the illustrative embodiment, the bottom wall 60 of the storage compartment of the retractable step 40 is supported on a plurality of bottom frame members 62, 64, 66. In particular, as shown in FIGS. 7 and 10, the plurality of bottom frame members 62, 64, 66 includes side frame members 62, 64 and front frame member 66.

As shown in FIGS. 7-10, in the illustrative embodiment, the retractable step 40 further comprises a plurality of casters 72 (e.g., five (5) casters 72). The plurality of casters 72 slide along the floor as the retractable step 40 is displaced between the stowed position and the extended position. In the illustrative embodiment, two (2) of the casters 72 may be attached to the side bottom frame member 62, two (2) of the casters 72 may be attached to the side bottom frame member 64, and one (1) of the casters 72 may be attached to the front bottom frame member 66. Also, as depicted in FIGS. 7-10, the retractable step 40 is connected to the cabinet body portion by a pair of slidable tracks 48, 50 in the illustrative embodiment. More particularly, a first one 48 of the slidable tracks 48, 50 may attach the peripheral sidewall 52 of the retractable step 40 to the interior surface of the sidewall 24 of the bathroom vanity 100, and the a second one 50 of the slidable tracks 48, 50 may attach the peripheral sidewall 54 of the retractable step 40 to the interior surface of the sidewall 26 of the bathroom vanity 100. Also, in the illustrative embodiment, the front wall panel 68 of the retractable step 40 further comprises a pair of handles 70 disposed on a front surface thereof for facilitating the grasping and pulling of the retractable step 40 from the stowed position to the extended position by a user (see FIGS. 1, 2, 4, 5, 7, and 8). That is, when a user wants to pull the retractable step 40 from its stowed position to its extended position, he or she grasps the handles 70 with his or her hands, and pulls out the step 40.

It is readily apparent that the aforedescribed the bathroom vanity 100, which is provided with the retractable step 40, offers numerous advantages. First of all, as described above, the bathroom vanity 100 with the built-in retractable step 40 enables individuals with a small stature, such as children, to reach items on the top of the bathroom vanity 100 (e.g., the sink faucet) without requiring a separate step stool, and without requiring help from someone else (e.g., a parent or older brother or sister). Secondly, the retractable step 40 of the bathroom vanity 100 is easily pulled out from the vanity 100 when needed, and then easily retracted back into vanity 100 when it is not needed. Finally, the retractable step 40 of the bathroom vanity 100 has a built-in storage compartment so that the step may also be used as a drawer to store various items (e.g., towels or toiletries).

Any of the features or attributes of the above described embodiments and variations can be used in combination with any of the other features and attributes of the above described embodiments and variations as desired. Also, as it is used throughout this disclosure, the conjunction "and/or" means one, or the other, or both (e.g., when it is said that the removable lid of the storage compartment is configured to engage with one or more of the peripheral sidewalls and/or one or more of the spaced-apart interior walls, this means that the removable lid of the storage compartment is configured to engage with one or more of the peripheral sidewalls, with one or more of the spaced-apart interior walls, or with one or more of the peripheral sidewalls and one or more of the spaced-apart interior walls).

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A bathroom vanity, comprising:

a cabinet body portion including a top wall and a plurality of sidewalls, the cabinet body portion defining a bottom recess with an open bottom; and a retractable step slidingly coupled to the cabinet body portion, the retractable step being displaceable between a stowed position where the retractable step is disposed within the bottom recess of the cabinet body portion and an extended position where the retractable step extends outwardly from a front of the cabinet body portion so as to provide a step for a user of the bathroom vanity, the retractable step being configured to slide along a floor on which the bathroom vanity is disposed when the retractable step is displaced between the stowed position and the extended position, and at least a portion of the retractable step being configured to contact the floor when the retractable step is displaced between the stowed position and the extended position, the retractable step further comprising a removable lid, at least one peripheral sidewall, and at least one interior wall spaced apart from the at least one peripheral sidewall by a gap, the removable lid of the retractable step further comprising one or more protruding members extending from a bottom surface of the removable lid, the one or more protruding members configured to be inserted into the gap between the at least one peripheral sidewall and the at least one interior wall.

2. The bathroom vanity according to claim 1, wherein the top wall of the cabinet body portion is in the form of a countertop with an aperture for accommodating a sink bowl.

3. The bathroom vanity according to claim 1, wherein the cabinet body portion further comprises a main cabinet compartment with at least one door pivotably mounted to the cabinet body portion, the at least one door pivotal between a closed position where the main cabinet compartment is generally enclosed and an open position where a user is able to gain access to an interior of the main cabinet compartment.

4. The bathroom vanity according to claim 1, wherein the plurality of sidewalls of the cabinet body portion comprise a first sidewall, a second sidewall oppositely disposed relative to the first sidewall, and one or more rear walls partially enclosing a backside of the cabinet body portion.

5. The bathroom vanity according to claim 1, wherein the retractable step further defines a storage compartment for receiving one or more items configured to be stored within the bathroom vanity, the removable lid configured to enable the user to gain access to the storage compartment.

6. The bathroom vanity according to claim 5, wherein the removable lid is further configured to form a top stepping surface of the retractable step when the removable lid is covering the storage compartment.

7. The bathroom vanity according to claim 6, wherein the one or more protruding members of the removable lid of the retractable step are in the form of one or more block members, the one or more block members of the removable lid configured to be received in the gap between the at least one peripheral sidewall and the at least one interior wall of the retractable step so as to retain the removable lid in place.

8. The bathroom vanity according to claim 6, wherein the removable lid of the retractable step is not pivotally attached to a frame portion of the retractable step by a hinge.

9. The bathroom vanity according to claim 6, wherein the at least one peripheral sidewall of the retractable step further comprises a plurality of peripheral sidewalls bounding the storage compartment, and the retractable step additionally comprises a bottom wall, the peripheral sidewalls forming at least a part of a frame portion of the retractable step.

10. The bathroom vanity according to claim 9, wherein the at least one interior wall of the retractable step further comprises a pair of spaced-apart interior walls, each of the pair of spaced-apart interior walls spaced apart from a respective one of the peripheral sidewalls.

11. The bathroom vanity according to claim 1, wherein the retractable step further comprises a plurality of casters, the plurality of casters configured to slide along the floor as the retractable step is displaced between the stowed position and the extended position.

12. The bathroom vanity according to claim 1, wherein the bottom recess of the cabinet body portion is bounded by an interior top partition wall and at least two of the plurality of sidewalls of the cabinet body portion, the at least two of the plurality of sidewalls of the cabinet body portion defining exterior walls of the bathroom vanity, and the open bottom of the bottom recess configured to be bounded by the floor on which the bathroom vanity is disposed.

13. The bathroom vanity according to claim 1, wherein the retractable step is connected to the cabinet body portion by one or more slidable tracks.

14. The bathroom vanity according to claim 1, wherein the retractable step further comprises one or more handles disposed on a front wall of the retractable step for facilitating the grasping and pulling of the retractable step from the stowed position to the extended position by a user.

15. A bathroom vanity, comprising:

a cabinet body portion including a top wall and a plurality of sidewalls, the cabinet body portion defining a bottom recess with an open bottom; and a retractable step slidingly coupled to the cabinet body portion, the retractable step being displaceable between a stowed position where the retractable step is disposed within the bottom recess of the cabinet body portion and an extended position where the retractable step extends outwardly from a front of the cabinet body portion so as to provide a step for a user of the bathroom vanity, the retractable step defining a storage compartment for receiving one or more items configured to be stored within the bathroom vanity, the retractable step being configured to slide along a floor on which the bathroom vanity is disposed when the retractable step is displaced between the stowed position and the extended position, and at least a portion of the retractable step being configured to contact the floor when the retractable step is displaced between the stowed position and the extended position, the retractable step further comprising a removable lid, at least one peripheral sidewall, and at least one interior wall spaced apart from the at least one peripheral sidewall by a gap, the removable lid of the retractable step further comprising one or more protruding members extending from a bottom surface of the removable lid, the one or more protruding members configured to be inserted into the gap between the at least one peripheral sidewall and the at least one interior wall.

16. The bathroom vanity according to claim 15, wherein the removable lid is further configured to form a top stepping surface of the retractable step when the removable lid is covering the storage compartment.

17. The bathroom vanity according to claim 16, wherein the at least one peripheral sidewall of the retractable step further comprises a plurality of peripheral walls bounding the storage compartment, and the retractable step additionally comprises a bottom wall, the peripheral sidewalls forming at least a part of a frame portion of the retractable step.

18. The bathroom vanity according to claim 17, wherein the at least one interior wall of the retractable step further comprises a pair of spaced-apart interior walls, each of the pair of spaced-apart interior walls spaced apart from a respective one of the peripheral sidewalls.

19. The bathroom vanity according to claim 18, wherein the one or more protruding members of the removable lid of the retractable step are in the form of one or more block members, the one or more block members of the removable lid configured to be received in the gap between the at least one peripheral sidewall and the at least one interior wall of the retractable step so as to retain the removable lid in place.

20. The bathroom vanity according to claim 15, wherein the bottom recess of the cabinet body portion is bounded by an interior top partition wall and at least two of the plurality of sidewalls of the cabinet body portion, the at least two of the plurality of sidewalls of the cabinet body portion defining exterior walls of the bathroom vanity, and the open bottom of the bottom recess configured to be bounded by the floor on which the bathroom vanity is disposed.

* * * * *